US012357868B2

(12) United States Patent
Tzavaras

(10) Patent No.: US 12,357,868 B2
(45) Date of Patent: Jul. 15, 2025

(54) DOUBLE HOOP POD

(71) Applicant: Kosta Tzavaras, Thousand Oaks, CA (US)

(72) Inventor: Kosta Tzavaras, Thousand Oaks, CA (US)

( * ) Notice: Subject to any disclaimer, the term of this patent is extended or adjusted under 35 U.S.C. 154(b) by 193 days.

(21) Appl. No.: 18/356,038

(22) Filed: Jul. 20, 2023

(65) Prior Publication Data

US 2024/0024727 A1 Jan. 25, 2024

Related U.S. Application Data

(60) Provisional application No. 63/369,188, filed on Jul. 22, 2022.

(51) Int. Cl.
*A63B 21/22* (2006.01)
*A63B 21/00* (2006.01)

(52) U.S. Cl.
CPC ..... *A63B 21/22* (2013.01); *A63B 21/00069* (2013.01); *A63B 21/00192* (2013.01); *A63B 21/4033* (2015.10)

(58) Field of Classification Search
CPC ..... A63B 21/00069; A63B 21/00192; A63B 21/005; A63B 21/0051; A63B 21/0052; A63B 21/0056; A63B 21/0057; A63B 21/22; A63B 21/4033; A63B 21/4035; A63B 21/4049; A63B 22/201; A63B 22/203; A63B 22/208; A63B 23/03516; A63B 23/03533; A63B 23/03541; A63B 23/12; A63B 23/1209; A63B 2209/08; A63B 2210/00; A63B 2210/50; A63B 2225/09
See application file for complete search history.

(56) References Cited

U.S. PATENT DOCUMENTS 3,079,914 A * 3/1963 Bush ..... A61H 1/02 482/903
3,721,438 A * 3/1973 Kusmer ..... A63B 22/0002 482/56
4,611,807 A * 9/1986 Castillo ..... A63B 22/0005 482/119
4,720,099 A * 1/1988 Carlson ..... A63B 21/0052 482/901
4,730,829 A * 3/1988 Carlson ..... A63B 21/4001 482/901

(Continued)

FOREIGN PATENT DOCUMENTS

EP 4032591 A1 * 7/2022 ..... A61H 1/0274
ES 2628034 A1 * 8/2007

(Continued)

*Primary Examiner* — Gary D Urbiel Goldner

(57) ABSTRACT

A magnetic resistance elliptical exercise machine being made out of a single frame unit. The single frame unit has two circular bodies. Each circular body has a disk and a plate. The disk is located on an exterior surface of the exercise machine with the plate being located internally. Each plate and disk are connected by way of an arm and handle that allow the disk and plate to rotate with each other. A user uses the handle to rotate the disks in a circular manner providing the user with a beneficial arm exercise. The exercise machine has a resistance knob that allows the user to increase or decrease a magnetic resistance of the exercise machine.

19 Claims, 11 Drawing Sheets

(56) References Cited

U.S. PATENT DOCUMENTS 4,765,315 A * 8/1988 Krukowski ..... F16D 37/02 482/901
4,784,385 A * 11/1988 D'Angelo ..... A63B 21/00069 482/111
4,872,669 A * 10/1989 Henry ..... A63B 21/4047 482/137
5,145,472 A * 9/1992 Johnson, III ..... A63B 21/4049 482/37
5,679,104 A * 10/1997 Driscoll ..... A63B 21/002 482/1
6,117,093 A * 9/2000 Carlson ..... A63B 21/0056 482/44
7,789,816 B2 * 9/2010 Krietzman ..... A63B 22/0694 482/8
10,004,933 B2 * 6/2018 Lennox ..... A63B 69/0048
11,364,410 B2 * 6/2022 Hsu ..... A63B 21/015
2004/0033868 A1 * 2/2004 Van Straaten ..... B62M 3/02 482/110
2005/0003931 A1 * 1/2005 Mills ..... A63B 21/4035 482/92
2005/0227831 A1 * 10/2005 Mills ..... A63B 21/075 482/106
2008/0312052 A1 * 12/2008 Krietzman ..... A63B 22/0694 482/92
2011/0021955 A1 * 1/2011 Byblow ..... G09B 19/003 601/5
2014/0213414 A1 * 7/2014 Balandis ..... A63B 21/169 482/111
2018/0036573 A1 * 2/2018 Lennox ..... A63B 21/012
2023/0158366 A1 * 5/2023 Mills ..... A63B 22/16 280/87.041
2023/0381568 A1 * 11/2023 Tzavaras ..... A63B 21/16
2025/0025733 A1 * 1/2025 Tzavaras ..... A63B 21/4035

FOREIGN PATENT DOCUMENTS

GB 2413289 A * 10/2005 ..... A63B 21/0125
JP 2002282388 A * 10/2002
KR 101792216 B1 * 11/2017
KR 200492117 Y1 * 8/2020
WO WO-2007048230 A1 * 5/2007 ..... A63B 22/0002

* cited by examiner

DOUBLE HOOP POD

FIELD OF THE INVENTION

The present invention relates to resistance equipment. More specifically, the present invention is magnetic resistance elliptical machine used to exercise.

BACKGROUND OF THE INVENTION

Physical activity is much needed for a person to live a healthy lifestyle. Being physically active can provide a plurality of health benefits such as weight management, mental health, reduce risk of diseases, strengthen bones and muscle, etc. There are countless of benefits in which physical activity provides. Furthermore, there are countless of different activities that a person can participate in to obtain health benefits. Essentially any activity that stimulate a person's muscles is sufficient. There exist hundreds of thousands of different equipment used to assist a wide range of physical activity.

An objective of the present invention is to provide a device used for resistance training and resistance exercises. The present invention provides a device may be used for a wide range of exercises. Exercises which the present invention is able to cover are, but not limited to, upper core exercises, chest exercises, lower core exercises, and resistance exercises for weight loss and fat burning.

DETAIL DESCRIPTIONS OF THE INVENTION

Figure 1:
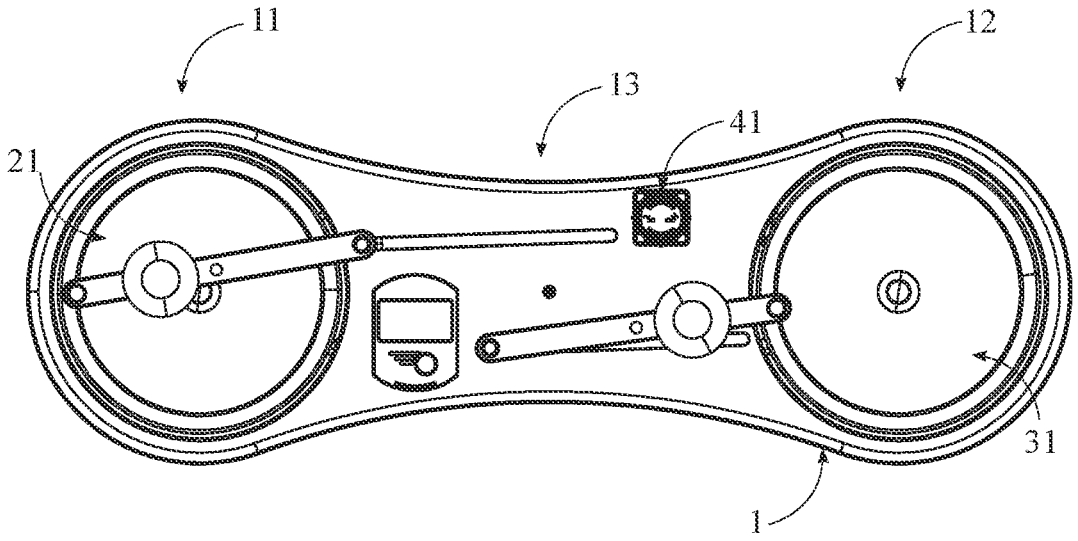
FIG. 1 is a front view of the present invention.
Figure 2:
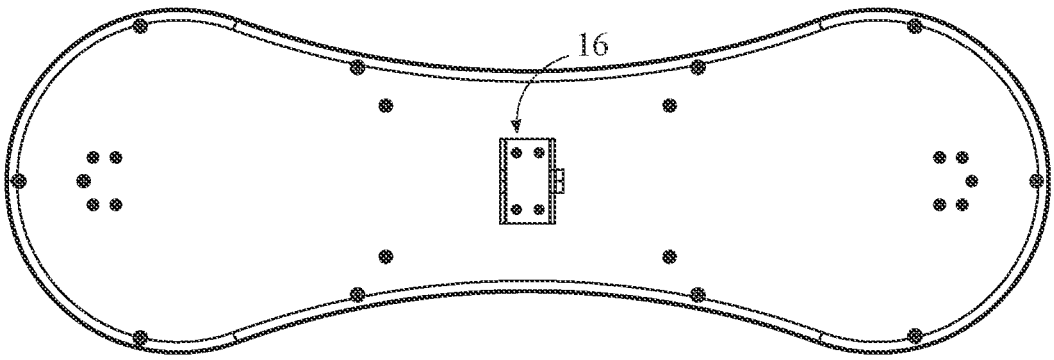
FIG. 2 is a rear view of the present invention.
Figure 3:
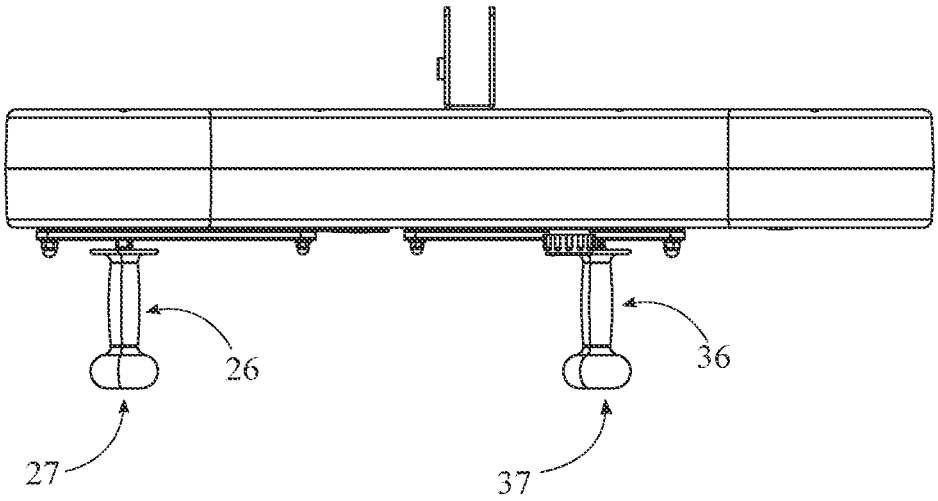
FIG. 3 is a top view of the present invention.
Figure 4:
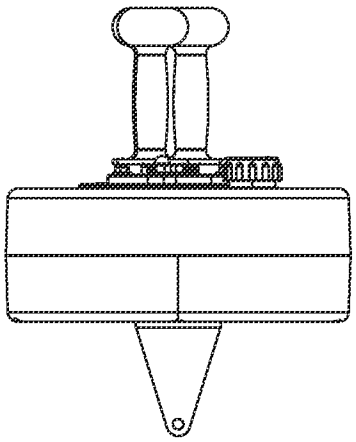
FIG. 4 is a right-side view of the present invention.
Figure 5:
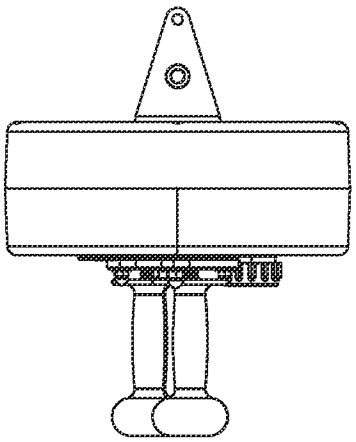
FIG. 5 is a left-side view of the present invention.

All illustrations of the drawings are for the purpose of describing selected versions of the present invention and are not intended to limit the scope of the present invention.

The present invention provides a device used for resistance training and resistance exercises. The present invention provides a device may be used for a wide range of exercises. Exercises which the present invention is able to cover are, but not limited to, upper core exercises, chest exercises, lower core exercises, and resistance exercises. The present invention comprises a frame 1, a first plate 22, a second plate 32, first disk 21, a second disk 31, a first rod 23, a second rod 33, a first handle 26, and a second handle 36. The present invention may be used in a variety of different ways depending on where the user attaches to the handle to the double hoop pod. If the user attaches the handles centrally on the first arm, the spinning will be done in an oval shaped motion. If the user opts to position the handles near the end of the arm, the spinning will produce a circular motion. The spinning produces circular or oval shaped motion depending on the position of the handle on the arm. When the handles are attached near the disk, the spinning produces a circular shaped motion. When the handles are attached away from the disk, the spinning will produce an oval-shaped motion. The user can spin the pods both spinning in the same direction or can rotate them opposite direction from one another or the user can spin one pod at a time in either direction. The double hoop pod uses magnetic resistance technology to increase the intensity of the exercise. The user can adjust the resistance by adjusting the resistance knob.

Figure 6:
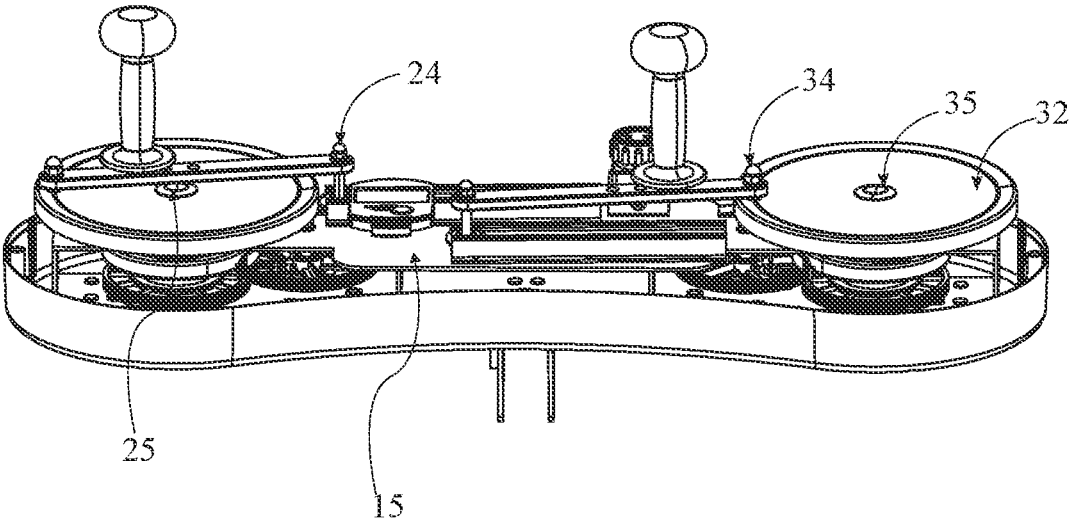
FIG. 6 is a front-bottom view of the present invention with the frame removed.
Figure 7:
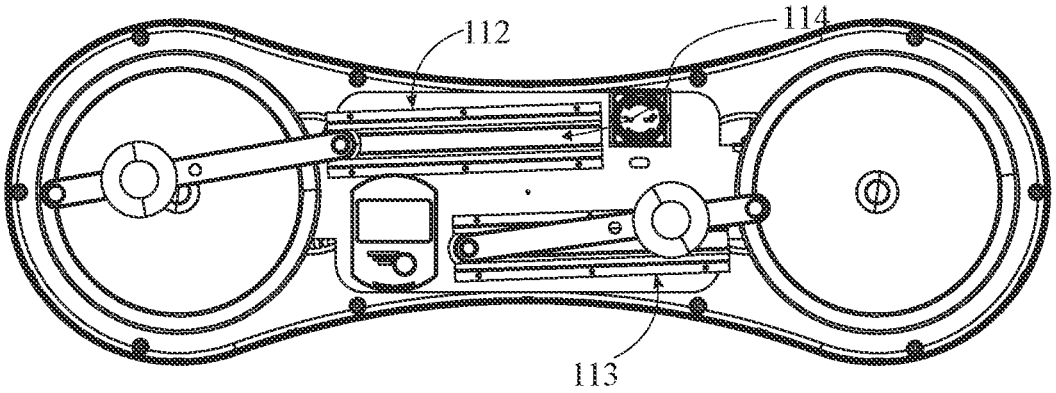
FIG. 7 is a front view of the present invention with the frame removed.
Figure 8:
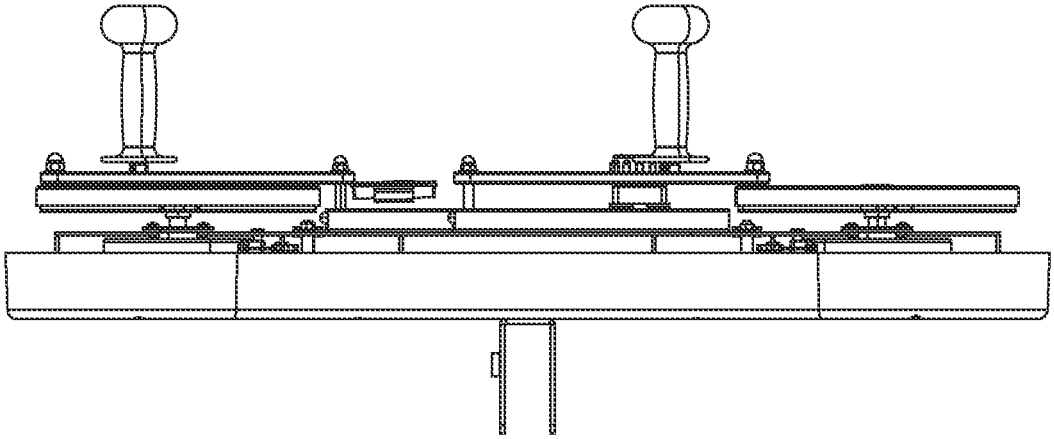
FIG. 8 is a bottom view of the present invention with the frame removed.
Figure 9:
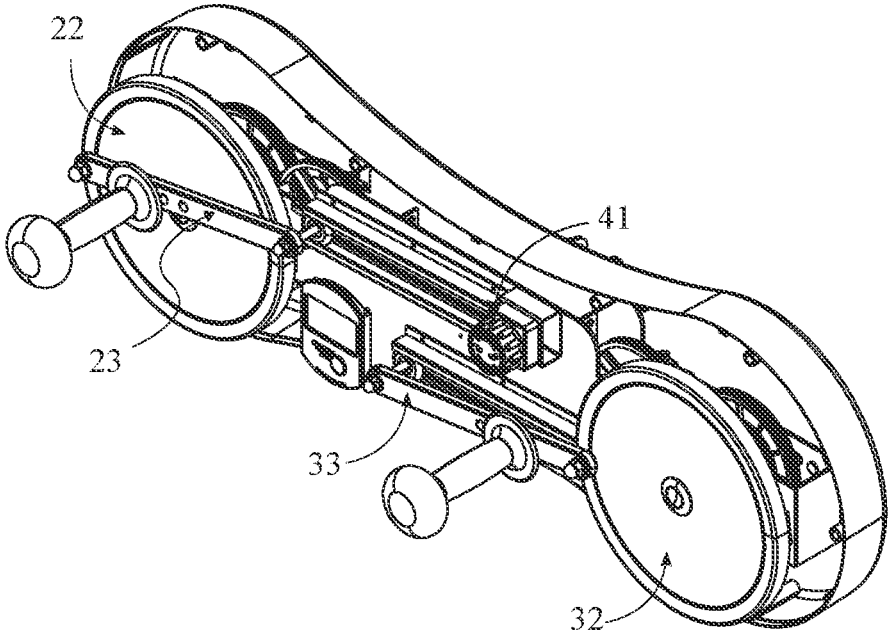
FIG. 9 is a front-top-right view of the present invention with the frame removed.
Figure 10:
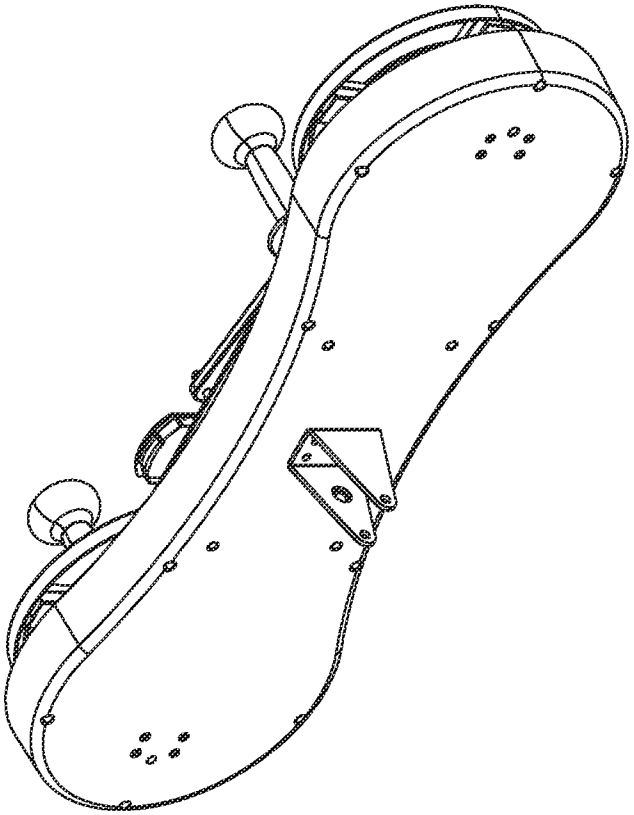
FIG. 10 is a rear bottom view of the present invention with the frame removed.
Figure 11:
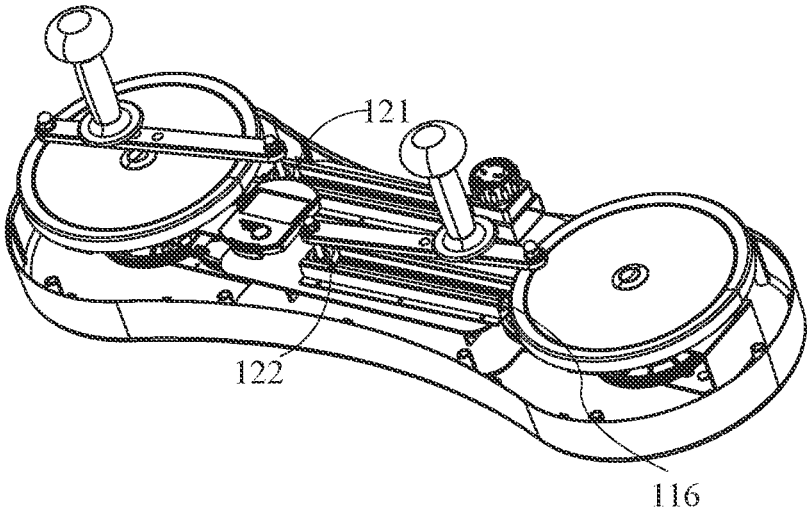
FIG. 11 is bottom-front isometric view of the present invention with the frame removed.

The frame 1 is the exterior frame 1 of the present invention. The frame 1 is a peculiar in shape. In addition, the frame 1 is vertically and horizontally symmetrical. The frame 1 mimics the shape of an oblong with the lengthy sides con-caving inwards as shown in FIGS. 1, 6, and 7. The frame 1 has a first circular body 11 and a second circular body 12. The central connector 13 is positioned between the first circular body 11 and the second circular body 12, allowing the central connector 13 to connect the first circular body 11 and second circular body 12. The central connector 13 has an external surface as well as an internal cavity 14. The internal cavity 14 is the space inside of the frame 1.

The first plate 22 is centrally located within the first circular body 11 as can be seen in FIG. 1 through 9. The first circular body 11 contains the first handle 26, first knob 27, a first rod 23, and a plurality of magnets. The second plate 32 is located within the second circular body 12 of the present invention. the second circular body 12 comprising a second handle 36, a second knob, a plurality of magnets and a second rod 33.

The first circular body 11 further comprises a first disk 21 and a first plate 22. The first disk 21 and first plate 22 rotate with each other by way of the first rod 23 and first handle 26. The first disk 21 is centrally positioned on an external surface of the first circular body 11. The first plate 22 is centrally positioned inside the first circular body 11 and the first plate 22 is held in place by way of a first central pin 25. The first disk 21 is able to rotate within the internal perimeters of the first circular body 11. The first central pin 25 traverses through the center of the first plate 22. The second circular body 12 further comprises a second disk 31 and a second plate 32. The second disk 31 and second plate 32 rotate with each other by way of the second rod 33 and second handle 36. The second disk 31 is centrally positioned on an external surface of the second circular body 12. The second plate 32 is centrally positioned inside the second circular body 12 and the second plate 32 is held in place by way of a second central pin 35. The second disk 31 is able to rotate within the internal perimeters of the second circular body 12. The second central pin 35 traverses through the center of the second plate 32.

The frame 1 houses all of the internal components of the double hoop magnetic resistance pod. Housed in the internal cavity 14 of the central connector 13 is a support shelf 15, a first track, and a second track 113. The support shelf 15 extends from the first central body to the second central body. The support shelf 15 provides a surface for the internal components to sit on allowing the components to function in tandem with one another. The support shelf 15 is a two layer metal chasses that supports the whole structure. It is made out metal to ensure its durability in supporting the other components. The first track 112 and second track 113 are formed by a set of parallel walls connected by a single wall forming a 3-sided unit open on one side. This opening on one side forms a canal. Sitting in the first track canal 114 and the second track canal 115 are movement mechanisms. A first movement mechanism 121 is slidably positioned in the first track canal 114 and will slide along the first track canal 114 as the pod is spun. Similarly, a second movement mechanism 122 is slidably is slidably positioned in the second track canal 115 and will slide along the canal as the pod is spun. In order to allow the two tracks to be used at the same time, they are positioned offset from one another with the first track 112 being positioned in the upper left quadrant of the support shelf 15 and the second track 113 being positioned in the lower right quadrant of the support shelf 15. The first rod 23 attaches to the first movement mechanism by way of first support bolt 24. The second rod 33 attaches to the second movement mechanism by way of a second support bolt. The first and second support bolt keep the rods attached to each of the movement mechanisms as they slide along the hollow canal each of the tracks.

The first rod 23 is an elongated pole that is parallel to the surface of the first disk 21. The first rod 23 is attached to the top surface of the first disk 21. The first rod 23 is attached at a fixed location on the first disk 21. The first disk 21 is attached to the first rod 23 opposite the first support bolt 24. The first rod 23 further comprises a first handle 26. The first and second handle 36 are movably attached to the first rod 23 and second rod 33 respectively meaning it has multiple positions it can attach to the first rod 23 at. If you attach the handle closer to the center of the rod, you will produce an oval rotation where if the handle it positioned towards one end, it will produce a circular rotation.

The first handle 26 has a first knob 27 attached opposite the first rod 23. The first knob 27 and second knob area cylindrical in shape giving the use a better method of holding on to the spin pod should they not want to use the handles. The second handle 36 is attached to the handle opposite the second rod 33. The first handle 26 is a cylindrical pillar that is the part by which the invention is held and operated. The first handle 26 assists the operations of the first rod 23 and the first disk 21. The first handle 26 protrudes on the top surface of the first rod 23. More specifically, the first handle 26 protrudes near the center of the first rod 23 towards the first disk 21.

The second rod 33 is an elongated pole that is parallel to the surface of the second disk 31. The second rod 33 is attached to the top surface of the second disk 31. The second rod 33 is attached at a fixed location on the second disk 31. The second rod 33 further comprises a second handle 36. The second disk 31 is attached to the second rod 33 opposite the second support bolt. The second handle 36 is a cylindrical pillar that is the part by which the invention is used for operating the machine. The second handle 36 assists the operations of the second rod 33 and the second disk 31. The second handle 36 protrudes on the top surface of the second rod 33. More specifically, the second handle 36 protrudes near the center of the second rod 33 towards the second disk 31.

Positioned on the connector central connector 13 is the resistance knob 41, which is cylindrical. One rotates the resistance knob 41 about its central access to adjust the plurality of magnets contained within the first circular body 11 and second circular body 12. On the rear side of the hoop pod is one or more frame connectors 16. This one or more frame connector 16 allows the pod to be connected to an upright frame one may find in the gym. A stand up frame allow for any attachment to be raised to different heights by way of a hole and pin mechanism. The present invention can be installed horizontally waist-high for core exercises, with the user holding the handles with the rods at 90-degree angle. In addition, the present invention can be installed vertically head-level high for upper core to chest-level workout, with the user holding the handles with the rods at approximately 135-degree angle. the plurality of magnets being positioned within the first circular body 11 and the second circular body 12. The product is installed on a fixed position on the wall, a floor stand, or a mechanized adjustable height-floor tower.

It is important to note that the first plate 22, the first disk 21, the first rod 23, and the first handle 26 are connected as one set, which can be referred to as the first set. Likewise, the second plate 32, the second disk 31, the second rod 33, and the second handle 36 are connected as another set on the opposing side of the first set. Furthermore, the two forementioned sets are mirror symmetrical with one another as they are connected to the frame 1.

Although the invention has been explained in relation to its preferred embodiment, it is to be understood that many other possible modifications and variations can be made without departing from the spirit and scope of the invention.

What is claimed is:

1. A magnetic resistance spin pod upper body exercise frame comprising:

a frame;

a first circular body;

a second circular body;

a central connector;

the central connector being positioned between the first circular body and the second circular body;

the first circular body comprising a first handle, a first knob, a first rod substantially perpendicular to the first handle, and a first plurality of magnets;

the first rod is an elongated pole parallel to a flat horizontal surface of the first circular body;

the second circular body comprising a second handle, a second knob, a second rod substantially perpendicular to the second handle, and a second plurality of magnets;

the second rod is an elongated pole parallel to a flat horizontal surface of the second circular body;

the first and second rods being substantially coplanar with one another; and the central connector having an external surface and an internal cavity.

2. The present invention as claimed in claim 1 wherein:

the first circular body further comprising a first disk and a first plate;

the first disk is centrally positioned on an external surface of the first circular body;

the first plate is centrally positioned inside the first circular body;

the first plate is held in position by way of a first central pin; and the first central pin traverses through a center of the first plate.

3. The present invention as claimed in claim 2 wherein:

the second circular body further comprising a second disk and a second plate;

the second disk is centrally positioned on an external surface of the second circular body;

the second plate is centrally positioned inside the second circular body;

the second plate is held in position by way of a second central pin; and the second central pin traverses through a center of the second plate.

4. The present invention as claimed in claim 3 wherein:
the internal cavity comprising a support shelf, a first track, and a second track;
the support shelf extending from the first circular body to the second circular body;
the first track being positioned in an upper left quadrant of the support shelf;
the second track being positioned in a lower right quadrant of the support shelf; and
the central connector further comprising a resistance knob.

5. The present invention as claimed in claim 4 wherein:
the resistance knob being positioned on the central connector between the second circular body and the first rod.

6. The present invention as claimed in claim 4 wherein:
the first track being a 3-sided unit forming a first hollow canal;
a first movement mechanism being slidably positioned in the first hollow canal of the first track;
the first rod being attached to the first movement mechanism by way of a first support bolt;
the second track being a 3-sided unit forming a second hollow canal;
a second movement mechanism being slidably positioned in the second hollow canal of second track; and
the second rod being attached to the second movement mechanism by way of a second support bolt.

7. The present invention as claimed in claim 6 wherein:
the first disk being attached to the first rod opposite the first support bolt;
the second disk being attached to the second rod opposite the second support bolt;
the first handle being rotatably attached to the first rod;
the first handle being attached to the first rod opposite the first disk;
the second handle being rotatably attached to the second rod; and
the second handle being attached to the second rod opposite the second disk.

8. The present invention as claimed in claim 4 wherein:
a frame connector being positioned on a rear side of the frame;
the resistance knob being a cylindrical structure;
the resistance knob rotating along a central axis of the resistance knob; and
the resistance knob adjusting a magnetic resistance of the first and second plurality of magnets to increase or decrease a resistance to rotation of the first and second handles relative to the first and second circular bodies, respectively.

9. The present invention as claimed in claim 1 wherein:
the first knob being attached to the first handle opposite the first rod;
the second knob being attached to the second handle opposite the second rod;
the first and second knob each being a cylindrical shape.

10. The present invention as claimed in claim 1 wherein:
the first plurality of magnets being positioned within the first circular body and the second plurality of magnets being positioned within the second circular body.

11. A magnetic resistance spin pod upper body exercise frame comprising:
a frame;
a first circular body;
a second circular body;
a central connector;
the central connector being positioned between the first circular body and the second circular body;
the first circular body comprising a first handle, a first knob, a first rod substantially perpendicular to the first handle, and a first plurality of magnets;
the first rod is an elongated pole parallel to a flat horizontal surface of the first circular body;
the second circular body comprising a second handle, a second knob, a second rod substantially perpendicular to the second handle, and a second plurality of magnets;
the second rod is an elongated pole parallel to a flat horizontal surface of the second circular body;
the first and second rods being substantially coplanar with one another;
the central connector having an external surface and an internal cavity;
the first circular body further comprising a first disk and a first plate;
the first disk is centrally positioned on an external surface of the first circular body;
the first plate is centrally positioned inside the first circular body;
the first plate is held in position by way of a first central pin; and
the first central pin traverses through a center of the first plate.

12. The present invention as claimed in claim 11 wherein:
the second circular body further comprising a second disk and a second plate;
the second disk is centrally positioned on an external surface of the second circular body;
the second plate is centrally positioned inside the second circular body;
the second plate is held in position by way of a second central pin;
the second central pin traverses through a center of the second plate;
the internal cavity comprising a support shelf, a first track, and a second track;
the support shelf extending from the first circular body to the second circular body;
the first track being positioned in an upper left quadrant of the support shelf;
the second track being positioned in a lower right quadrant of the support shelf; and
the central connector further comprising a resistance knob.

13. The present invention as claimed in claim 12 wherein:
the resistance knob being positioned on the central connector between the second circular body and the first rod;
the first track being a 3-sided unit forming a first hollow canal;
a first movement mechanism being slidably positioned in the first hollow canal of the first track;
the first rod being attached to the first movement mechanism by way of a first support bolt;
the second track being a 3-sided unit forming a second hollow canal;
a second movement mechanism being slidably positioned in the second hollow canal of second track; and
the second rod being attached to the second movement mechanism by way of a second support bolt.

14. The present invention as claimed in claim 13 wherein:
the first disk being attached to the first rod opposite the first support bolt;

the second disk being attached to the second rod opposite the second support bolt;

the first handle being rotatably attached to the first rod;

the first handle being attached to the first rod opposite the first disk;

the second handle being rotatably attached to the second rod;

the second handle being attached to the second rod opposite the second disk;

the first knob being attached to the first handle opposite the first rod;

the second knob being attached to the second handle opposite the second rod; and the first and second knob each being a cylindrical shape.

15. The present invention as claimed in claim 12 wherein:

a frame connector being positioned on a rear side of the frame;

the resistance knob being a cylindrical structure;

the resistance knob rotating along a central axis of the resistance knob;

the resistance knob adjusting a magnetic resistance of the first and second plurality of magnets to increase or decrease a resistance to rotation of the first and second handles relative to the first and second circular bodies, respectively; and the first plurality of magnets being positioned within the first circular body and the second plurality of magnets being positioned within the second circular body.

16. A magnetic resistance spin pod upper body exercise frame comprising:

a frame;

a first circular body;

a second circular body;

a central connector;

the central connector being positioned between the first circular body and the second circular body;

the first circular body comprising a first handle, a first knob, a first rod substantially perpendicular to the first handle, and a first plurality of magnets;

the first rod is an elongated pole parallel to a flat horizontal surface of the first circular body;

the second circular body comprising a second handle, a second knob, a second rod substantially perpendicular to the second handle, and a second plurality of magnets;

the second rod is an elongated pole parallel to a flat horizontal surface of the second circular body;

the first and second rods being substantially coplanar with one another;

the central connector having an external surface and an internal cavity;

the first circular body further comprising a first disk and a first plate;

the first disk is centrally positioned on an external surface of the first circular body;

the first plate is centrally positioned inside the first circular body;

the first plate is held in position by way of a first central pin;

the first central pin traverses through a center of the first plate;

the second circular body further comprising a second disk and a second plate;

the second disk is centrally positioned on an external surface of the second circular body;

the second plate is centrally positioned inside the second circular body;

the second plate is held in position by way of a second central pin; and the second central pin traverses through a center of the second plate.

17. The present invention as claimed in claim 16 wherein:

the internal cavity comprising a support shelf, a first track, and a second track;

the support shelf extending from the first circular body to the second circular body;

the first track being positioned in an upper left quadrant of the support shelf;

the second track being positioned in a lower right quadrant of the support shelf;

the central connector further comprising resistance knob; and the a resistance knob being positioned on the central connector between the second circular body and the first rod.

18. The present invention as claimed in claim 17 wherein:

the first track being a 3-sided unit forming a first hollow canal;

a first movement mechanism being slidably positioned in the first hollow canal of the first track;

the first rod being attached to the first movement mechanism by way of a first support bolt;

the second track being a 3-sided unit forming a second hollow canal;

a second movement mechanism being slidably positioned in the second hollow canal of second track;

the second rod being attached to the second movement mechanism by way of a second support bolt;

the first disk being attached to the first rod opposite the first support bolt;

the second disk being attached to the second rod opposite the second support bolt;

the first handle being movably attached to the first rod;

the first handle being attached to the first rod opposite the first disk;

the second handle being movably attached to the second rod; and the second handle being attached to the second rod opposite the second disk.

19. The present invention as claimed in claim 17 comprising:

the first knob being attached to the first handle opposite the first rod;

the second knob being attached to the second handle opposite the second rod;

the first and second knob each being a cylindrical shape;

the resistance knob rotating along a central axis of the resistance knob;

the resistance knob adjusting a magnetic resistance of the first and second plurality of magnets to increase or decrease a resistance to rotation of the first and second handles relative to the first and second circular bodies, respectively; and the first plurality of magnets being positioned within the first circular body and the second plurality of magnets being positioned within the second circular body.

* * * * *